United States Patent [19]

Oztekin

[11] 4,004,769

[45] Jan. 25, 1977

[54] DETACHABLE END PLATFORM FOR MERCHANDISE DISPLAY UNIT

[76] Inventor: Muammer A. Oztekin, P.O. Box 6247A, Birmingham, Ala. 35217

[22] Filed: Feb. 19, 1976

[21] Appl. No.: 659,535

[52] U.S. Cl. ..... 248/188.1; 52/285; 211/189

[51] Int. Cl.[2] ..... F16M 11/20

[58] Field of Search ..... 248/188.1; 52/750, 753 D, 52/753 C, 566, 281, 785; 211/189, 204, 205, 196, 198

[56] References Cited

UNITED STATES PATENTS

| | | | |
|---|---|---|---|
| 1,307,973 | 6/1919 | Hester | 52/753 D |
| 1,688,134 | 10/1928 | Braunstein | 52/285 |
| 2,912,013 | 11/1959 | Freyholdt et al. | 52/753 D |
| 3,736,599 | 6/1973 | Kessler et al. | 52/285 |

*Primary Examiner*—Robert A. Hafer
*Attorney, Agent, or Firm*—Woodford R. Thompson, Jr.

[57] ABSTRACT

An end platform side plate and the outer end of an adjacent shoe member for a merchandise display unit are detachably connected to each other by a removable, channel-like clip which slidably engages the inner surface of the side plate with one flange of the clip extending into and engaging an outwardly opening recess in the shoe member and the other flange of the clip engaging the inner surface of an upstanding bracket carried by the side plate.

4 Claims, 4 Drawing Figures

DETACHABLE END PLATFORM FOR MERCHANDISE DISPLAY UNIT

BACKGROUND OF THE INVENTION

This invention relates to a detachable end platform for a merchandise display unit and more particularly to improved means for detachably connecting an end platform side plate to the outer end of an adjacent shoe member whereby the end platform may be quickly and easily installed and removed.

Heretofore in the art to which my invention relates, difficulties have been encountered in installing and removing end platforms for merchandise display units. Due to the slant of the sides of end plates for toe space, the usual practice has been to position uprights with shoe members attached into the end platform bases. Such an assembly has been unsatisfactory since the end platform cannot be installed on merchandise display units which are already installed. Neither can the end platform be removed after it is installed without unloading the merchandise display unit and then lifting the upright with its shoe member out of the end platform base. Accordingly, the end platform cannot be used temporarily for sales in various departments of a store. Furthermore, the end platform cannot be removed whereby the area beneath the end platform can be maintained in a clean condition at all times. adding or removing end platform bases has also been a problem in the erection of merchandise display units due to the fact that all of the components of the display unit do not arrive at the point of installation at the same time. Accordingly, with multiple trailer-loads shipped to customers, if often happens that the customer cannot set up any complete section with end platform until the bases have also arrived.

SUMMARY OF THE INVENTION

In accordance with my invention, I provide improved means for detachably connecting the side plates of the end platform to the shoe member at any time with a minimum of time and effort. Accordingly, the end platform may be installed after the usual uprights and shoe members have been installed and the end platform may be removed at any time after installation without having to remove merchandise from the display stand. The side plates of the end platform are detachably connected to the outer ends of the shoe members for the merchandise display stand by removable, channel-like clip members which slidably engage the inner surface of the side plate with one flange of the clip extending into and engaging an outwardly opening recess in the shoe member and the other flange of the clip engaging the inner surface of an upstanding bracket carried by the side plate. The upstanding bracket has an inwardly extending portion formed integrally at its inner end with a laterally extending portion which terminates in an outturned portion whereby the adjacent portion of the clip is secured firmly in place after installation, and yet the clip may be readily removed by sliding the clip longitudinally relative to the adjacent portion of the side plate and its upstanding bracket and the adjacent portion of the shoe member.

DESCRIPTION OF THE DRAWINGS

A detachable end platform for a merchandise display unit embodying features of my invention is illustrated in the accompanying drawings, forming a part of this application, in which.

DETAILED DESCRIPTION

Figure 1:
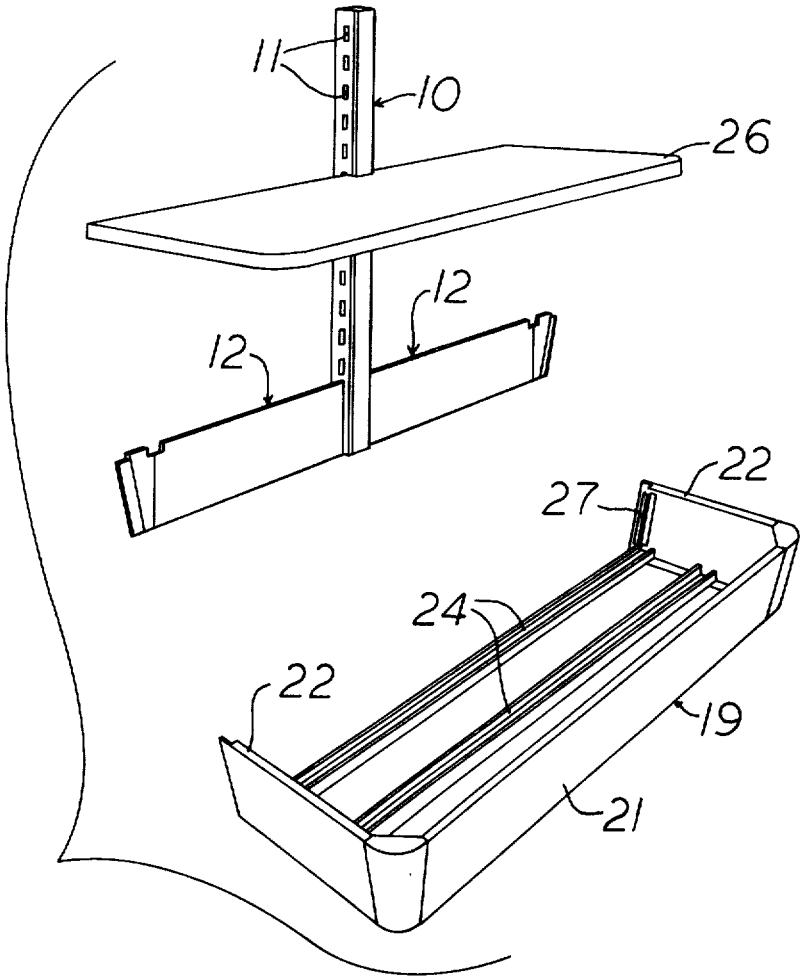
FIG. 1 is an exploded, perspective view showing the end platform base removed from the shoe members which are carried by a conventional upright.

Referring now to the drawings for a better understanding of my invention, I show a conventional upright 10 for a merchandise display unit. The upright 10 is provided with the usual, vertically spaced slots 11 for detachably receiving support brackets for shelf members. In view of the fact that such support brackets and shelf members are conventional equipment, no further description thereof is deemed necessary.

Figure 4:
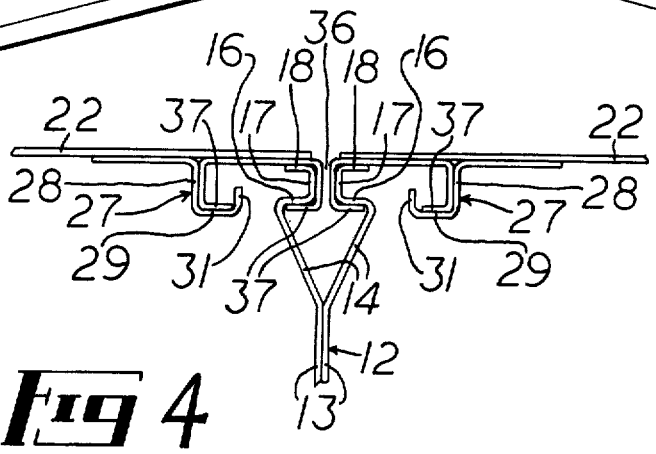

Upstanding shoe members 12 are detachably connected to the lower end of the upright 10, as shown in FIG. 1, whereby the shoe member project outwardly from opposite sides of the upright 10. As shown in FIG. 4, each shoe member 12 is formed of adjacent, parallel plates 13 which are secured rigidly to each other by suitable means, such as by spot welding. The outer ends of the parallel plates 13 flare outwardly away from each other to provide outwardly flaring portions 14 which are formed integrally at their outer ends with portions that extend inwardly toward each other as at 16 and then outwardly generally parallel to each other as at 17 and then laterally away from each other as at 18.

As shown in FIG. 1, the end platform indicated at 19 comprises a front wall or plate 21 which is connected to upstanding side plates 22. Secured to the upstanding plates 21 and 22 are suitable reinforcing members 24 to add rigidity to the base of the end platform 19. Engaging the upper edges of the upstanding plates 21 and 22 is a top member 26 for the end platform.

Secured to the inner surface of each side plate 22 in spaced relation to the free end of the side plate is an upstanding bracket 27 which comprises an inwardly extending portion 28 formed integrally at its inner end with a laterally extending portion 29 which terminates in an outturned portion 31.

Figure 2:
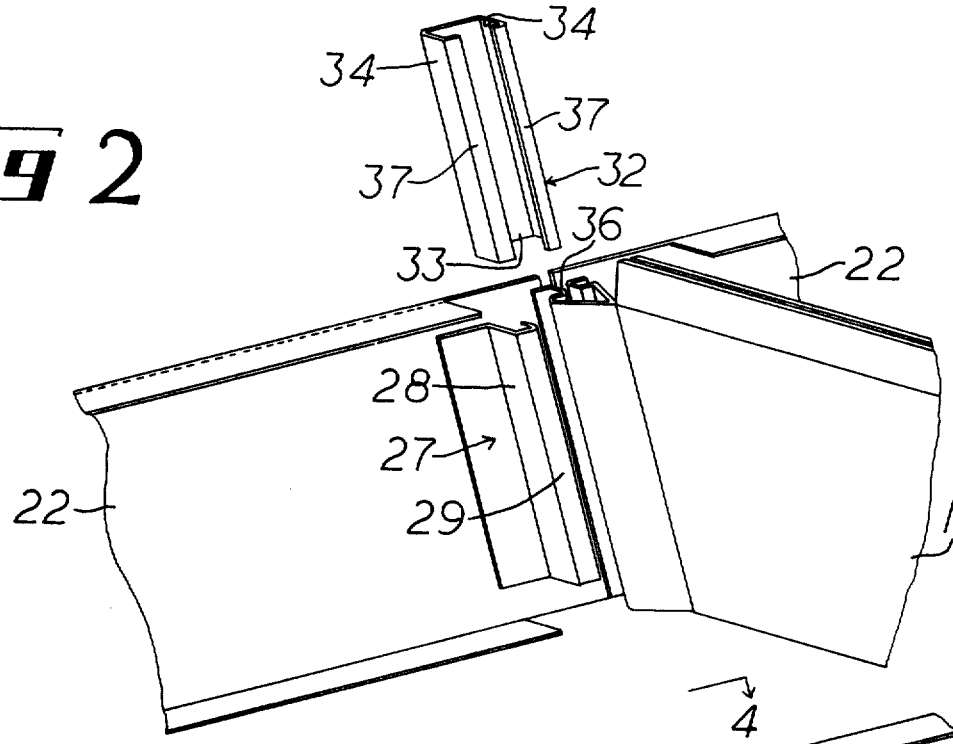
FIG. 2 is a fragmental, perspective view showing the outer end of a shoe member positioned adjacent the ends of side plates with the channel-like locking clip being in position for movement into locking relationship with the shoe member and the side plates.
Figure 3:
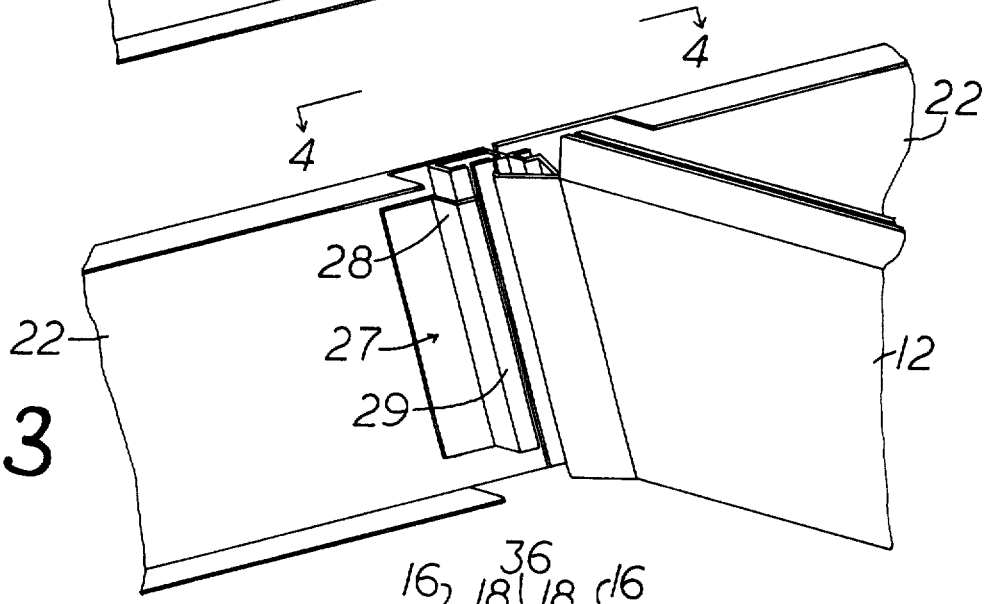
FIG. 3 is a fragmental, perspective view corresponding to FIG. 2 but showing the channel-like locking clip moved into locking position; and, FIG. 4 is an enlarged, top plan view taken generally along the line 4—4 of FIG. 3.

The ends of the upstanding side plates 22 are detachably connected to the outermost end of the adjacent shoe member 12 by a channgellike clip 32, as shown in FIGS. 2, 3 and 4. The channel-like clip 32 comprises a web 33 which slidably engages the inner surface of the adjacent side plate 22 with one flange 34 of the clip 32 extending into and engaging an outwardly opening recess 36 which is defined between the parallel portions 17 of the parallel plates 13, as shown in FIG. 4. The other flange 34 of the channel-like clip 32 engages the inner surface of the upstanding bracket 27, as shown. The inner edges of the flanges 34 of the channel-like clip 32 are formed integrally with laterally extending members 37 which extend toward each other in position to engage the laterally portion 29 of the upstanding bracket 27 and the portion 16 of the parallel plates 13 which extend toward each other, as shown in FIG. 4. To further secure the clip 32 firmly to the upstanding brackets 27, the laterally extending members 37 of the clip 32 engage the inner surface of the outturned portions 31 of the upstanding bracket 27 and the inner surface of an outwardly flaring portion 14 of the parallel plates 13, as shown.

From the foregoing description, the manner in which my improved end platform is detachably connected to the adjacent upstanding shoe member will be readily understood. The end platform 19 is positioned whereby the free ends of the side plates 22 are positioned adjacent the outer ends of the shoe members 12, as shown in FIG. 2. The channel-like clip 32 is then moved downwardly to the position shown in FIGS. 3 and 4 whereby the ends of the side plates 22 are detachably connected to the outer end of the shoe member 12. The top 26 may then be placed on the upper edges of the upstanding plates 21 and 22 whereby it is supported therefrom in a conventional manner. To remove the end platform after installation, the shelves supported by the upright 10 do not have to be removed. Upon removal of the top 26, the channel-like clip 32 may be easily removed by moving the same from the position shown in FIG. 3 to the position shown in FIG. 2 whereby the upstanding plate may be readily separated from the adjacent end of the shoe member 12.

From the foregoing, it will be seen that I have devised improved means for detachably connecting an end platform to upstanding shoe members. Accordingly, the end platform may be installed on existing merchandise display sections without having to unload the section. Also, the end platform can be removed after it is installed unloading the section and lifting the upright out of the end plate base. Furthermore, my improved means for detachably connecting the end platform to the shoe member permits the end platform to be used temporarily for sales in various departments of a store. Furthermore, by providing an end platform which may be readily and easily removed, the area under the end platform may be cleaned with a minimum of effort.

While I have shown my invention in but one form, it will be obvious to those skilled in the art that it is not so limited, but is susceptible of various changes and modifications without departing from the spirit thereof.

What I claim is:

1. In a detachable end platform for merchandise display unit embodying at least one upstanding shoe member formed of adjacent parallel plates and extending generally perpendicular to at least one upstanding side plate with the outer end of said shoe member terminating adjacent one end of said side plate, means detachably connecting said one end of said side plate to said outer end of said shoe member comprising:

a. an outwardly opening recess in said outer end of said shoe member between said adjacent parallel plates, b. an upstanding bracket carried by the inner side of said side plate in spaced relation to said one end thereof, said bracket having one end fixed to said side plate and further comprising a first portion extending away from said side plate, a second, laterally extending portion extending from said first portion and substantially parallel to said plate, and terminating in a third portion extending toward said plate, and, c. a channel-like clip having a web slidably engaging the inner surface of said plate with one flange of said clip extending into an engaging said outwardly opening recess and the other flange of said clip engaging the inner surface of said upstanding bracket so that said clip connects said side plate to said shoe member.

2. A detachable end platform as defined in claim 1 in which said outwardly opening recess is said outer end of said shoe member is defined by outwardly flaring portions of said parallel plates which are formed integrally at their outer ends with portions which extend toward each other and then outwardly generally parallel to each other and then laterally away from each other.

3. A detachable end platform as defined in claim 2 in which the inner edges of said flanges of said channel-like clip are formed integrally with laterally extending members which extend toward each other in position to engage said laterally extending portion of said upstanding bracket and said portions of said parallel plates of said shoe members which extend toward each other.

4. A detachable end platform as defined in claim 3 in which said laterally extending members of said clip engage the inner surface of said outturned portion of said upstanding bracket and the inner surface of an outwardly flaring portion of said parallel plates.

* * * * *